US009210957B2

(12) United States Patent
Conde et al.

(10) Patent No.: US 9,210,957 B2
(45) Date of Patent: Dec. 15, 2015

(54) WEARABLE CHILD SEAT COSTUME

(71) Applicants: Marco Conde, Delray Beach, FL (US); Tiffany Conde, Delray Beach, FL (US)

(72) Inventors: Marco Conde, Delray Beach, FL (US); Tiffany Conde, Delray Beach, FL (US)

( * ) Notice: Subject to any disclaimer, the term of this patent is extended or adjusted under 35 U.S.C. 154(b) by 0 days.

(21) Appl. No.: 14/565,828

(22) Filed: Dec. 10, 2014

(65) Prior Publication Data

US 2015/0289572 A1 Oct. 15, 2015

Related U.S. Application Data

(60) Provisional application No. 61/978,278, filed on Apr. 11, 2014.

(51) Int. Cl.
*A63H 33/00* (2006.01)
*A41D 11/00* (2006.01)
*A41D 1/00* (2006.01)

(52) U.S. Cl.
CPC . *A41D 11/00* (2013.01); *A41D 1/00* (2013.01)

(58) Field of Classification Search
USPC ..... 446/26, 27, 28, 71, 72; 297/219.12, 297/228.1, 229
See application file for complete search history.

(56) References Cited

U.S. PATENT DOCUMENTS 4,595,618 A * 6/1986 Caringer ..... A63H 3/00 280/801.1
4,695,092 A 9/1987 Hittie
5,112,104 A * 5/1992 De Giacomi ..... B60N 2/60 297/181
5,114,185 A * 5/1992 Reedom ..... B60R 22/00 280/801.1
5,137,335 A 8/1992 Marten
5,560,680 A 10/1996 Salvador et al.
5,707,107 A * 1/1998 Melone ..... B60N 2/6027 297/228.1
6,142,575 A * 11/2000 Patterson ..... B60R 22/024 280/801.1
6,409,271 B1 * 6/2002 Caramanis ..... B60R 22/00 280/801.1
7,703,417 B2 4/2010 Wu
7,785,167 B2 * 8/2010 Friend-Douglass . A47D 15/006 297/181
D636,213 S 4/2011 Carter
7,942,478 B2 5/2011 Cymbalski et al.
D676,679 S * 2/2013 Cymbalski ..... D6/333
D696,531 S 12/2013 Roychoudhury
2001/0035671 A1 * 11/2001 Brooks ..... A47D 1/00 297/188.03
2005/0206207 A1 * 9/2005 Kenny ..... B60N 2/6009 297/228.1
2012/0264349 A1 10/2012 Ciampitti et al.

FOREIGN PATENT DOCUMENTS

JP 2001-105944 4/2001

* cited by examiner

*Primary Examiner* — Kurt Fernstrom
(74) *Attorney, Agent, or Firm* — Jason T. Daniel, Esq.; Daniel Law Offices, P.A.

(57) ABSTRACT

A wearable child seat costume includes a themed costume body having a shape and size that is complementary to the sitting area of a child seat. The costume body includes a plurality of openings that correspond to the safety straps of the child seat. The costume further includes a plurality of seatbelt pads, a pair of removable gloves, a removable mask and a removable cape.

20 Claims, 4 Drawing Sheets

WEARABLE CHILD SEAT COSTUME

CROSS-REFERENCE TO RELATED APPLICATIONS

This application claims the benefit of U.S. Application Ser. No. 61/978,278 filed on 11 Apr. 2014, the contents of which are incorporated herein by reference.

TECHNICAL FIELD

The present invention relates generally to ornamental costumes for children, and more particularly to a themed costume having portions that can be secured to a child's seat and portions that are wearable by a child.

BACKGROUND

The statements in this section merely provide background information related to the present disclosure and may not constitute prior art.

As any parent will attest, there is nothing more important than the safety of your child. For this reason, manufacturers of child seats such as car seats, booster seats, child wheelchairs, strollers, and highchairs, for example, spend a great deal of time and money to ensure their products meet or exceed safety standards. As such, ornamental features such as colors, toys and/or themes must take a back seat to functionality.

Owing to this function-over-form approach, traditional child seats having restraints and the like can be extremely intimidating to young children, as there is nothing that would be perceived as fun or even welcoming to a small child. Moreover, even in those rare instances where child seats are manufactured with superhero prints or other such decorations, they tend to be commercially unsuccessful, because the children quickly get bored with the same design, and the parents are then unable to use the same design for other children who have different likes and interests.

Accordingly, it would be beneficial to provide a wearable child seat costume which can provide a fun and welcoming experience to a child, can be enjoyed while the child is both in and out of their seat, and that does not suffer from the drawbacks of the above noted devices.

SUMMARY OF THE INVENTION

The present invention is directed to a wearable child seat costume. One embodiment of the present invention can include a costume body having a shape and size that is complementary to the sitting area of a child seat. The costume body can include a plurality of openings that correspond to the safety straps of the child seat. A plurality of seatbelt pads can be provided to cover the safety straps, and a pair of gloves, a mask and a cape can be removably secured to the costume body to transform the child seat into a three dimensional representation of a fanciful character.

Another embodiment of the present invention can include a padded liner and waterproof liner which can be disposed along the seat section of the costume body.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
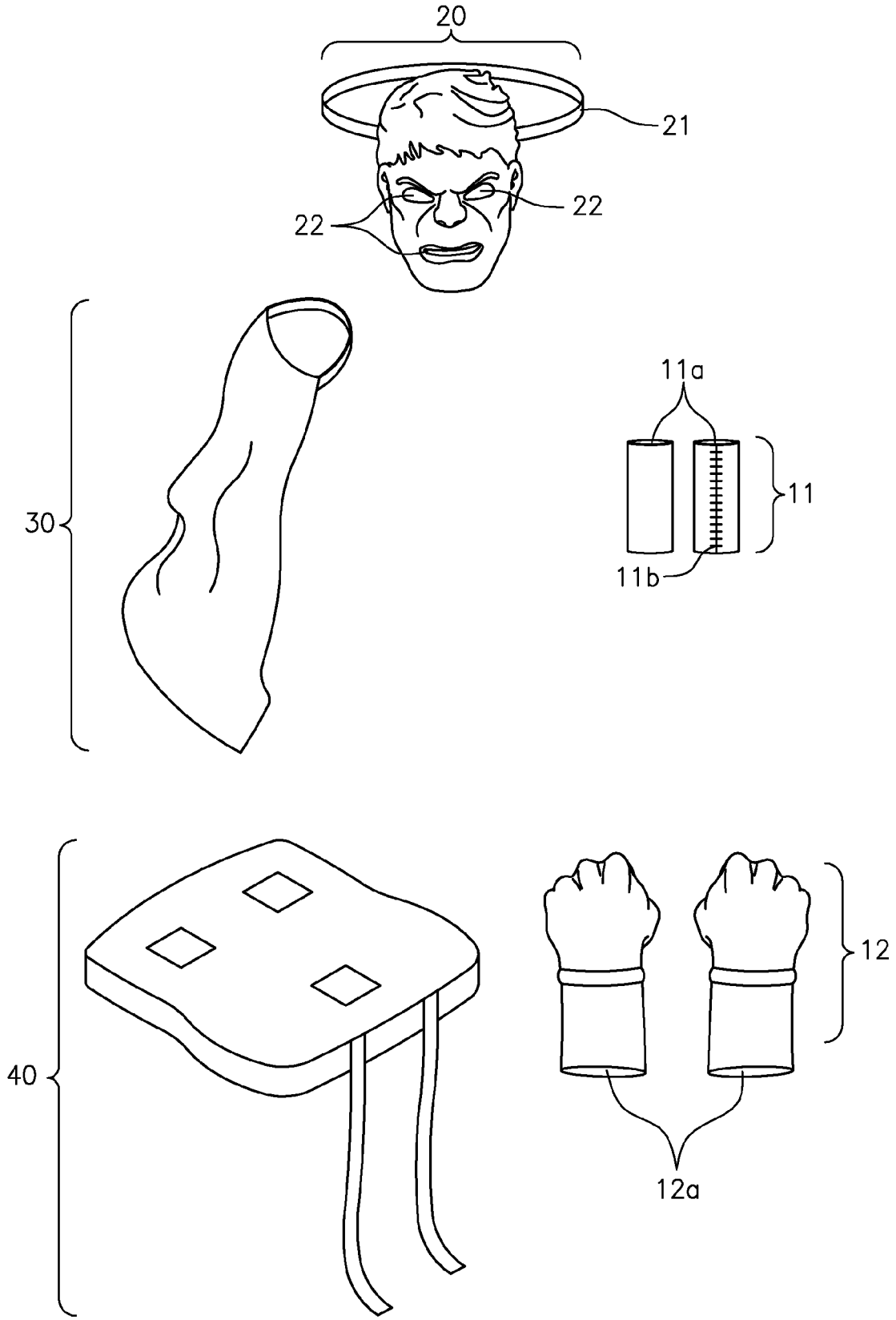
FIG. 1 is an exploded parts view of a wearable child seat costume that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

DEFINITIONS

As described throughout this document, the term "child seat" shall refer to any commercially available seat that is manufactured for, or capable of being utilized by a child. Several nonlimiting examples include, car seats, booster seats, child wheelchairs, strollers, and highchairs, for example.

As described herein, the term "connector," and derivatives thereof can include any number of different elements capable of repeatedly securing two items together in a nonpermanent manner (i.e., removably secured). Several nonlimiting examples include opposing strips of hook and loop material (e.g., Velcro®), magnetic elements, tethers such as straps and ties, and compression fittings such as hooks, snaps and buttons, for example. Each illustrated connector can be permanently secured to the illustrated portion of the device via a permanent sealer such as glue, adhesive tape, or stitching, for example.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As will be described throughout this document, a wearable child seat costume 10 can function to transform a conventional child seat into a three dimensional representation of a fanciful character, such as a superhero, a sport's figure, a biblical character, a storybook character, a comic book character, an animal, a cartoon character, and/or other imaginable items such as a locomotive, an airplane, and a vehicle, for example.

To this end, each of the below described components can include an unlimited number of decorative costume themes that incorporate elements such as colors, glow in the dark coatings, markings, words, shapes, symbols, logos, designs, light producing devices such as LED's for example, sound producing devices such as speakers, for example, types of materials, texturing of materials, patterns, images, lithographs, photographs and/or simulated jewels such as rubies, diamonds, emeralds and the like.

Moreover, although not particularly illustrated, the costume 10 can also include any number of secondary themed items such as simulated weaponry (i.e., swords and guns), crowns, wigs, clothing and the like, which can augment the above described costume theme.

FIG. 1 illustrates an exploded parts view of one embodiment of a wearable child seat costume 10 that is useful for understanding the inventive concepts disclosed herein. As shown, the costume/kit 10 can include, a plurality of seatbelt pads 11, a pair of detachable costume gloves 12, a detachable costume mask 40 one or more costume accessories such as a cape 30, and a costume body 40 that can be secured onto a conventional child seat.

Figure 5:
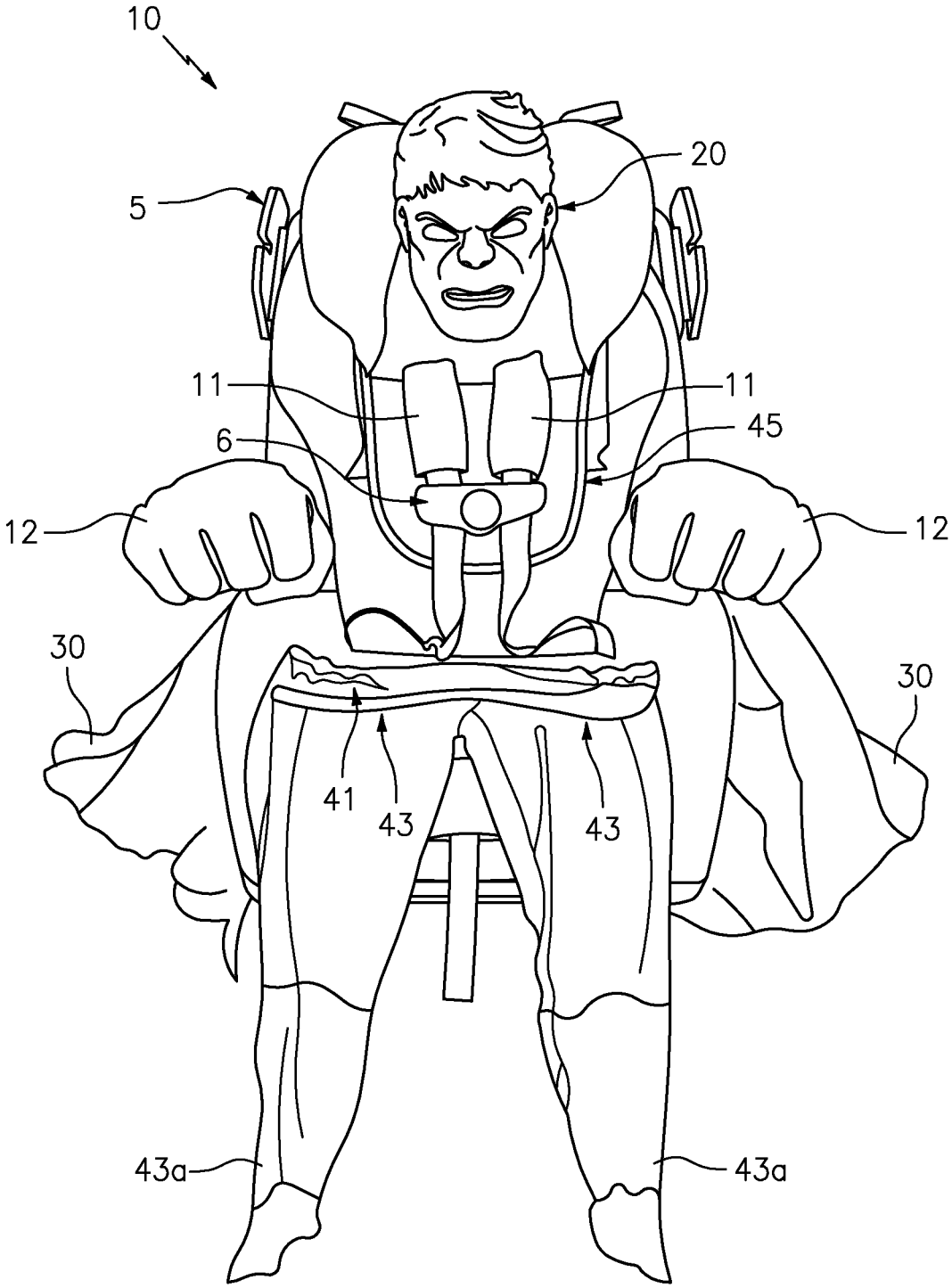
FIG. 5 is a perspective view of the wearable child seat costume in operation, and in accordance with one embodiment of the invention.

The seatbelt pads 11 can function to cover the safety restraints of the child seat onto which the costume is installed (See FIG. 5). In this regard, each of the seatbelt pads 11 can include a generally tubular member having a central aperture 11*a* forming a sleeve through which the safety restraint of the child seat can be positioned. In the preferred embodiment, each of the seatbelt pads can preferably be constructed from a soft lightweight material such as padded cotton, for example, in order to increase comfort to the child. In another embodiment, one or more of the seatbelt pads can further include a releasable seam 11*b* (such as strips of hook and loop material, for example), in order to allow the pads to open and close about the safety restraints.

The costume gloves 12 can be removably secured to the armrests of the child seat and/or the below described costume body 40 via a connector (preferably hook and loop material), in order to provide the appearance that the child seat has arms and hands. Additionally, the gloves can be removed from the costume body so as to be worn by the child. In this regard, each of the gloves 12 can include a fanciful shape such as accessorized hands, claws or talons, for example, having an opening 12*a* along one end into which the child's hands can be placed. The gloves can be made from any number of suitable flexible materials such as cloth, plastic and the like, to suit the particular theme of the costume 10, and to allow the child to have full range of motion when wearing the glove. As such, in one embodiment, each of the fingers of the glove can move individually, or the glove can remain in a generally static position, such as the first illustrated in FIG. 3.

The costume mask 20 can be removably secured to either the child seat and/or the costume body 40 via connectors, in order to provide the appearance that the child seat has a head. Additionally, the mask can be removed from the costume body so as to be worn by the child. In this regard, the mask can include any number of fanciful shapes such as a tiger, monster, or superhero, for example, and can further include a plurality of openings 21 at appropriate locations to allow the child to easily see, breathe and speak when using the mask. Additionally, the mask can further include an adjustable strap 22 which can fit about the child's head, securing the mask to the child. In one embodiment, the strap 22 can include an elastic strap, which can be utilized to secure the mask body onto the child seat. In either instance, the mask itself can be constructed from any number of suitable materials such as plastic, cardboard and the like, to suit the particular theme of the costume 10.

Figure 2:
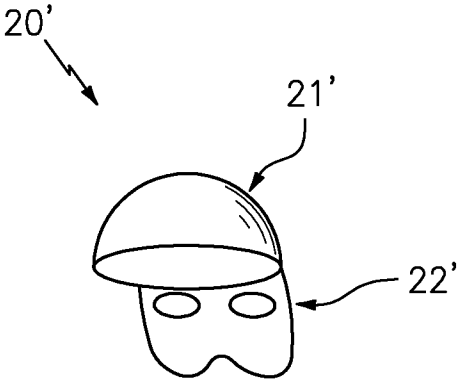
FIG. 2 is a perspective view of the costume mask of the wearable child seat costume, in accordance with one embodiment of the invention.

Although illustrated above as including a complete facemask and strap, those of skill in the art will recognize that any number of different types and shapes of masks can be provided. Accordingly, FIG. 2 illustrates another embodiment of the mask 20' which can be provided with the system 10. As shown, the mask 20' can include a skull cap design having a cap portion 21' and a partial face portion 22' that is designed to only cover the eyes of the child. Such a feature can be beneficial for small children wherein their nose and/or mouths would not be positionable near the mask.

Figure 3:
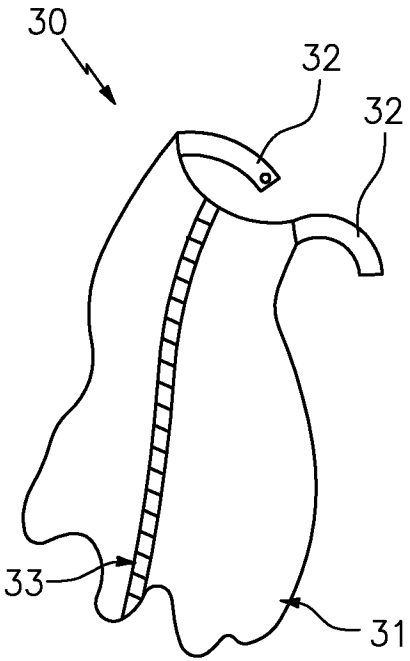
FIG. 3 is a perspective view of the costume cape of the wearable child seat costume, in accordance with one embodiment of the invention.

As shown in FIG. 3, the costume cape 30 can include a body section 31 and an adjustable strap 32, which can function to allow the cape to be worn by the child and/or secured onto the child seat. In either instance, the cape can be constructed from any number of suitable materials such as cloth or plastic, for example, and can further include any number of different fanciful shapes and sizes to suit the particular theme of the costume 10.

In those instances where the cape is secured onto the child seat, it can function to provide the appearance that the child seat is wearing a cape. In this regard, one embodiment of the cape can further include a releasable seam 33 running the length of the main body. The seam functioning to allow the cape to be positioned along either side of the child seat (See FIG. 5) so as to not affect the ability of the child seat to be secured within a vehicle.

The costume body 40 can function as a decorative element that can be physically secured to a conventional child seat, in order to transform the same into a simulative character. In this regard, the costume body is not intended to be worn by a child, but can be easily removed from the child seat for laundering or for use on a different child seat.

Figure 4B:
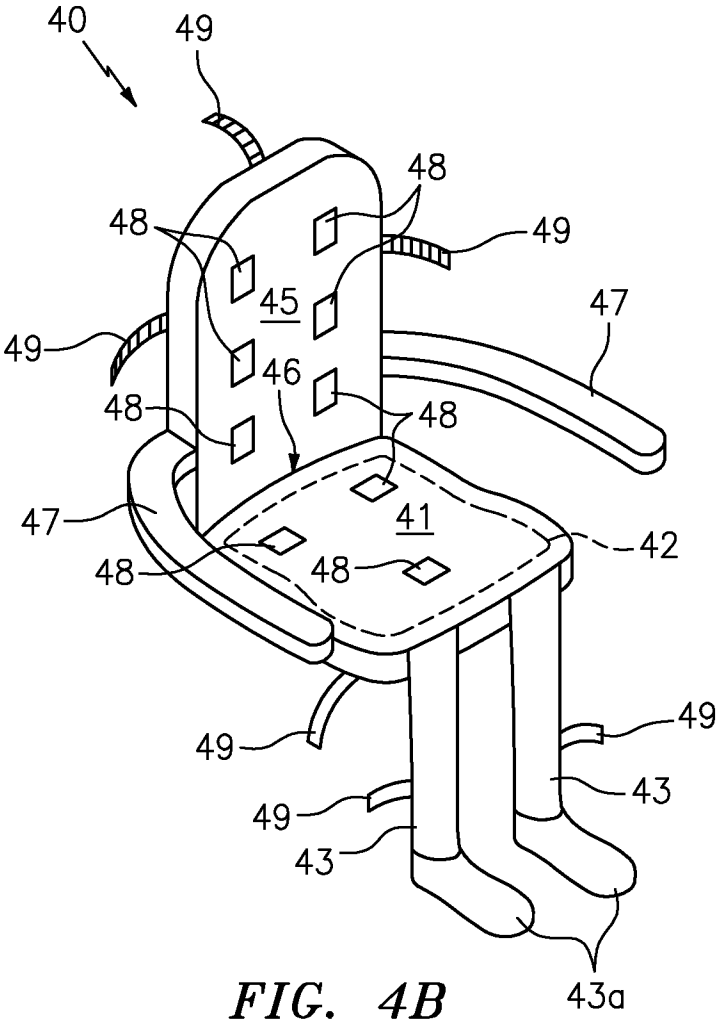
FIG. 4B is a perspective view of the costume body of the wearable child seat costume, in accordance with another embodiment of the invention.
Figure 4A:
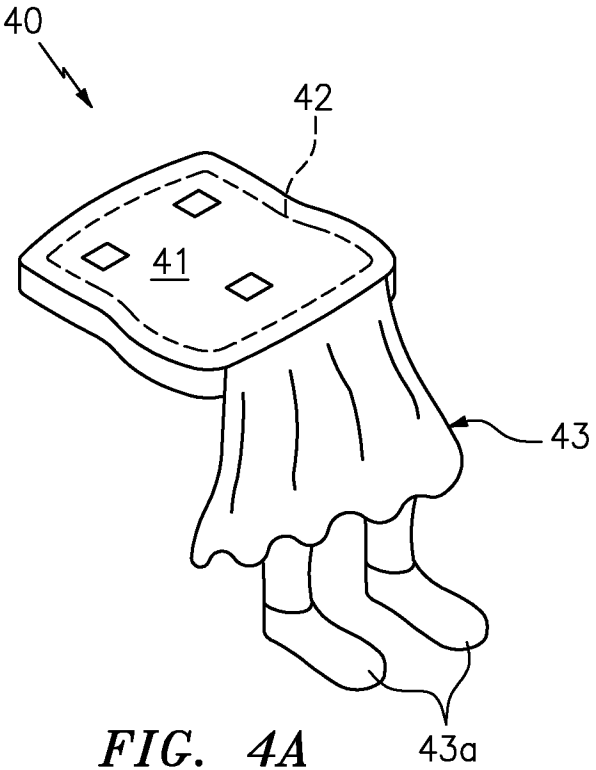
FIG. 4A is a perspective view of the costume body of the wearable child seat costume, in accordance with one embodiment of the invention.

As shown in FIG. 4A, one embodiment of the costume body 40 can include a seat section 41 having a shape, size and dimension that is complementary (i.e., nearly identical) to the shape, size and dimension of the seat section of the child seat onto which the costume 10 is intended to be used. In one embodiment, optional padding and/or a waterproof liner 42 can be embedded within, or secured to the bottom surface of the seat section 41. By including a liner and/or seat padding, the costume body 40 can function to enhance the comfort of the child seat, and/or to protect the same against stains caused from liquids and other such items.

A pair of malleable leg sections 43 can extend downward from the seat section 41. The leg sections can function to provide the appearance that the car seat has legs, and can further give life to the costume 10. As shown in both FIGS. 4A and 4B, the leg sections can appear to be wearing a dress/tutu, or pants, for example, and can terminate into the shape of a foot, boots or ballerina shoes 43*a*, for example. Of course, any number of other shapes and designs are also contemplated.

FIG. 4B illustrates another embodiment of the costume body 40 that further includes a back section 45 that is either permanently or removably joined to the seat section 41 along a common edge 46. In this regard, the back section 45 can include a shape, size and dimension that is complementary (i.e., nearly identical) to the shape, size and dimension of the back section of the child seat onto which the costume 10 is intended to be used.

As shown, a pair of malleable arm sections 47 can extend outward from the sides of the back section 45. Each of the arm sections including a shape and size that is complementary to the shape and size of the arm rest of the child seat to which the device 10 is intended to be secured. In one preferred embodiment, the arm sections can be constructed from a generally elastomeric material so as to be fitted onto the child seat armrests, although any number of other materials are also contemplated.

As described herein, each of the seat and back sections can preferably be constructed from a lightweight, generally malleable fabric material such as cotton, for example. Cotton is a common and widely accepted material for clothing and other such articles that are safe for direct and prolonged exposure to human skin. Of course any number of other fabrics and/or materials can also be used for the costume body. Several nonlimiting examples include natural materials such as wool, and/or synthetic materials such as polyester or rayon, for example.

As the costume body is intended to be secured onto a child seat, one embodiment of the costume 10 can further include a plurality of openings 48 which can be disposed throughout each of the seat and back sections 41 and 45, respectively, so as to accommodate the safety restraints typically found on child seats. Additionally, a plurality of connectors 49 can be disposed along one or more of the seat, back, arm and/or leg sections, in order to allow the seat body to be secured to the child seat in a removable manner.

Although illustrated as including openings 48 and connectors 49 at particular locations, this is for illustrative purposes only, as each of these elements can be positioned at any location along the costume body 40 in order to securely affix the body onto a child seat in a manner that will not affect the operation and/or safety of the same.

Additionally, it is contemplated that the costume body 40 can be created utilizing any construction methodology, manufacturing techniques and/or seam connectors which include, for example, stitching, liquid seams and hem tape, among others, for example. In this regard, the costume body 40 can be formed as one continuous element through the use of a singular piece of material milled or machined with the aforementioned components forming identifiable sections thereof, or one or more elements of the costume body can removably secured together via a connector.

FIG. 5 illustrates one embodiment of the costume 10 secured onto a child seat 5 having a plurality of safety restraints 6 disposed thereon. As noted above, each element of the costume 10 can work together to transform the child seat and/or the child into a fanciful character. In this regard, the seat section 41 and/or the back section 45 of the costume body can be positioned onto the sitting area of the child seat 5, and secured thereto by means of connectors (not illustrated). Once positioned thereon, the seatbelt pads 11 can be secured about the safety restraints 6. Finally, the costume gloves 12 can be removably attached to the arms of the child seat, and the mask 20 and cape 30 can be removably attached to the top portion of the car seat 5 and/or the costume body 22.

It is contemplated that the above described costume 10 can be utilized in at least three distinct manners. For example, one contemplated use would be when the child is in the car seat 5 and being driven about. In this mode, the costume elements are initially affixed to the car seat, and once the child is secured within the car seat 5 via the safety restraints 6, he or she can wear one or more of the mask 20 and gloves 12. Such a feature allows the child to wear portions of the costume 10 while sitting in the car seat 5, thereby bringing them amusement and making the car seat experience more fun.

A second manner of use would be where selected elements of the themed costume 10 are removed from the car seat and worn by the child when the child is not being restrained in the car seat. These elements generally would include the gloves 12, the mask 20, and the cape 30 (or equivalent). A third manner of use would be where each element of the costume 10 is secured to the car seat 5, and the child is merely sitting in the car seat with no costume elements being worn.

Accordingly, the above described wearable child seat costume 10 can function to provide a fun and welcoming environment for a child without affecting the safety and/or operation of the child seat. Moreover, as the device can be installed and removed from any child seat within minutes, the device advantageously allows parents of children to easily launder and/or replace the costume with a different themed character to suit the needs of any child.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A costume kit for use with a child seat having a sitting area and a plurality of safety restraints, said kit comprising:

a costume body that includes a seat section having a pair of malleable leg sections connected thereto, and a plurality of seatbelt pads, each of said pads including a generally tubular shaped member having a central aperture for engaging one of the safety restraints of the child seat;

a pair of costume gloves that are removably secured to malleable arm sections of the costume body; and a costume mask that is removably secured to the child seat.

2. The kit of claim 1, wherein each of the costume body, seatbelt pads, costume gloves and costume mask include a decorative costume theme.

3. The kit of claim 2, wherein each of the costume body, seatbelt pads, costume gloves and costume mask function to transform the child seat into a three dimensional representation of a fanciful character.

4. The kit of claim 3, wherein said fanciful character includes, at least one of a superhero, a sport's figure, a biblical character, a storybook character, a comic book character, an animal, a cartoon character, a locomotive, an airplane, and a vehicle.

5. The kit of claim 1, wherein said costume body further includes a plurality of openings that are disposed along the seat section of the costume body, said openings corresponding to a location where each of the safety restraints connect to the seating area of the child seat.

6. The kit of claim 1, further comprising:

a waterproof liner that is in communication with the seat section of the costume body.

7. The kit of claim 1, further comprising:

a padded liner that is in communication with the seat section of the costume body.

8. The kit of claim 1, further comprising:

a costume cape having an adjustable strap, and being removably secured to the costume body.

9. The kit of claim 1, wherein each of the costume gloves further includes an opening disposed along one end, said opening being configured to receive a hand of the human child.

10. The kit of claim 9, wherein each of said gloves are constructed from a flexible material and are configured to allow complete movement of the child's hand.

11. The kit of claim 9, wherein each of said gloves are constructed from a semi-flexible material and are configured to maintain a static position.

12. The kit of claim 9, wherein each of said gloves includes a fanciful shape.

13. The kit of claim 12, wherein said fanciful shape includes at least one of a hand, a claw, and a talon.

14. The kit of claim 1, wherein said costume mask includes a fanciful shape.

15. The kit of claim 13, wherein said fanciful shape includes at least one of a tiger, a monster, and a superhero.

16. The kit of claim 1, wherein at least one of the plurality of seatbelt pads further includes a removable seam that is positioned along the main body, said seem functioning to allow the seatbelt pad to transition between an open and closed position.

17. The kit of claim 1, wherein each of the malleable leg sections further include at least one of a foot and boot section disposed along a distal end thereof.

18. The kit of claim 1, wherein the pair of malleable leg sections includes a tutu shape.

19. A costume kit for use with a child seat having a sitting area and a plurality of safety restraints, said kit comprising:

a costume body that includes a seat section having a pair of malleable leg sections connected thereto, and a back section having a pair of malleable arm sections connected thereto, said seat and back sections being connected along a common edge;

a plurality of seatbelt pads, each of said pads including a generally tubular shaped member having a central aperture for engaging one of the safety restraints of the child seat;

a pair of costume gloves that are removably secured to malleable arm sections of the costume body; and a costume mask that is removably secured to the child seat.

20. The kit of claim 19, wherein said costume body further includes a plurality of openings that are disposed along each of the seat section and the back section of the costume body, said openings corresponding to a location where each of the safety restraints connect to the seating area of the child seat.

* * * * *